United States Patent [19]

Sauer

[11] Patent Number: 4,470,239

[45] Date of Patent: Sep. 11, 1984

[54] SUSPENDED CEILING GRID SYSTEM

[75] Inventor: Gale E. Sauer, Williamsville, N.Y.

[73] Assignee: Donn Incorporated, Westlake, Ohio

[21] Appl. No.: 214,250

[22] Filed: Dec. 8, 1980

[51] Int. Cl.[3] ..... E04B 5/52

[52] U.S. Cl. ..... 52/777; 52/667; 52/778; 52/241

[58] Field of Search ..... 52/665, 664, 668, 484, 52/475, 144, 311, 778, 488, 717, 232, 667, 781, 729, 482; 403/230, 347, 393, 364

[56] References Cited

U.S. PATENT DOCUMENTS

| | | | |
|---|---|---|---|
| 1,253,216 | 1/1918 | Day | 52/364 |
| 2,191,161 | 2/1940 | Romanoff | 52/668 |
| 2,734,127 | 2/1956 | Naysmith | 52/484 |
| 3,023,865 | 3/1962 | Brandstetter | 52/484 |
| 3,202,077 | 8/1965 | Lee . | |
| 3,207,057 | 9/1965 | Brown . | |
| 3,221,466 | 12/1965 | Downing | 52/DIG. 5 |
| 3,228,163 | 1/1966 | Lindstrom . | |
| 3,248,839 | 5/1966 | Roberts et al. . | |
| 3,253,082 | 5/1966 | Buset . | |
| 3,292,332 | 12/1966 | Jahn | 52/484 |
| 3,332,189 | 7/1967 | Blatnik . | |
| 3,548,556 | 12/1970 | Vermeulen | 52/669 |
| 3,589,086 | 6/1971 | Schilling . | |
| 3,834,106 | 10/1974 | Astedt et al. . | |
| 3,928,950 | 12/1975 | Beynon | 403/393 |
| 4,021,986 | 5/1977 | McCall | 52/475 |
| 4,108,563 | 8/1978 | Brown | 52/667 |
| 4,115,970 | 9/1978 | Weinar | 52/311 |
| 4,272,937 | 6/1981 | Brugman | 52/484 |

FOREIGN PATENT DOCUMENTS

| | | | |
|---|---|---|---|
| 942924 | 3/1974 | Canada | 52/364 |

*Primary Examiner*—John E. Murtagh

*Attorney, Agent, or Firm*—Pearne, Gordon, Sessions, McCoy, Granger & Tilberry

[57] ABSTRACT

A suspended ceiling grid system formed of main runners (10) and cross runners (40) disposed at right angles to the main runners to define grid openings for the reception of ceiling tiles (T). Each of the runners (10, 40) includes a bulb (12, 42) a pair of webs (14, 44) depending from the bulb to define a recess therebetween, and a pair of tile supporting flanges (16, 46) extending in opposite directions from the lower edges of the webs. The tiles (T) when assembled onto the flanges (16, 46) of the main and cross runners (10, 40) resiliently displace the webs (14, 44) from their normal unstressed positions to cause the webs to center the tile. Simulation means (76) is carried by the runners in underlying relationship at the intersection of the main and cross runners (10, 40) to simulate a continuous recess at the intersection.

11 Claims, 15 Drawing Figures

Fig. 1.
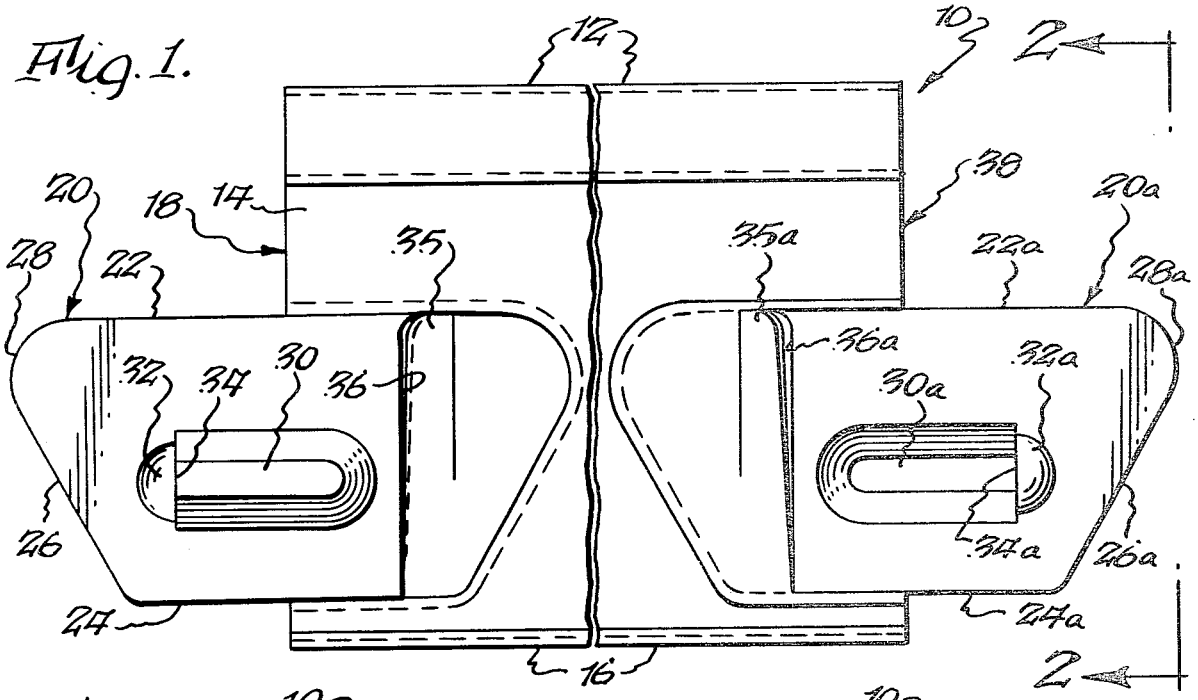
Fig. 3
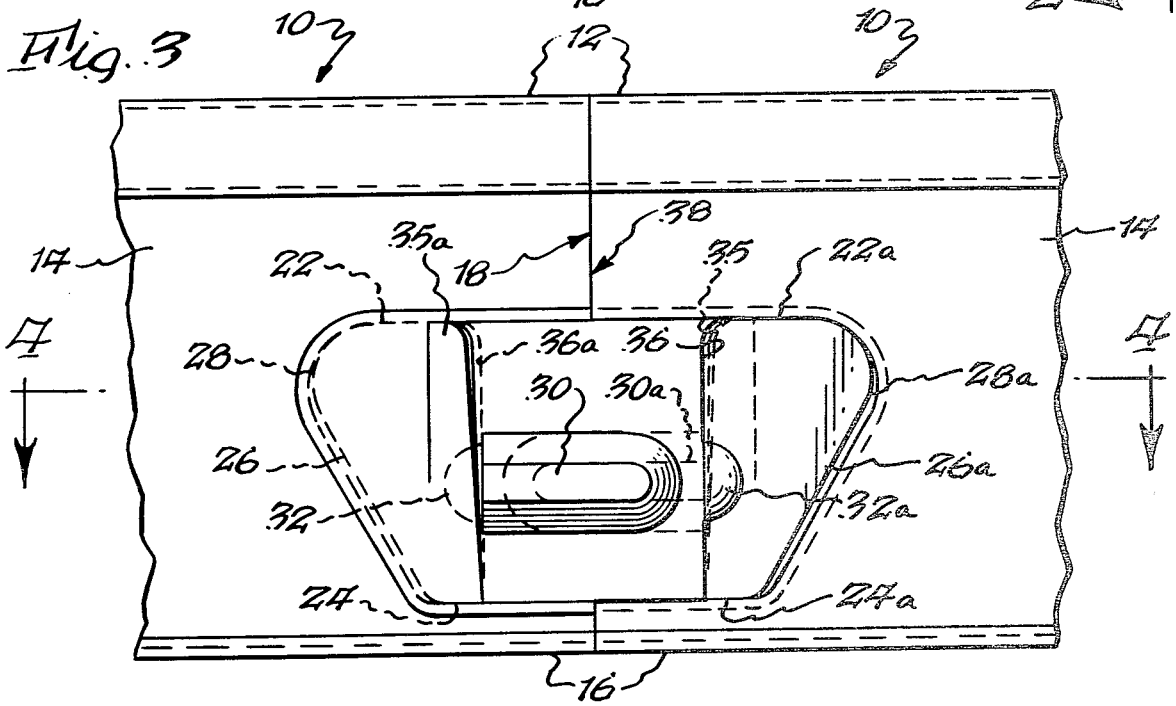
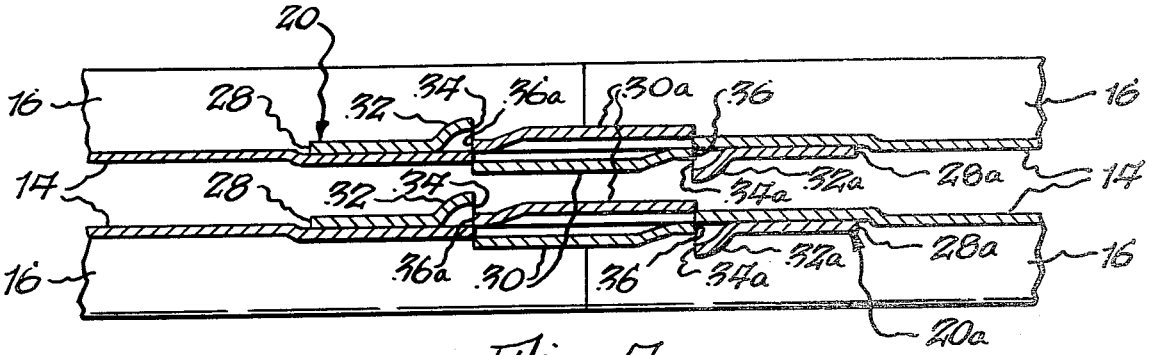
Fig. 4.

Fig. 2.
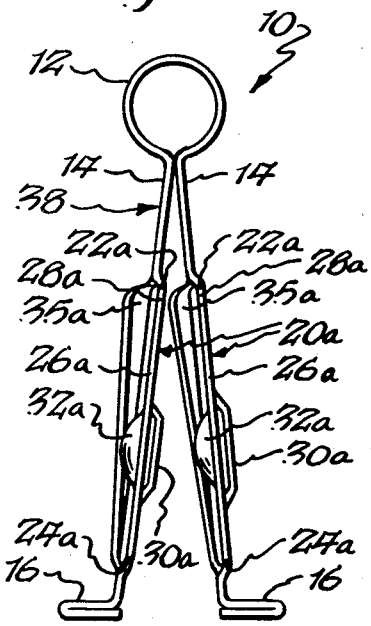
Fig. 10.
Fig. 11.
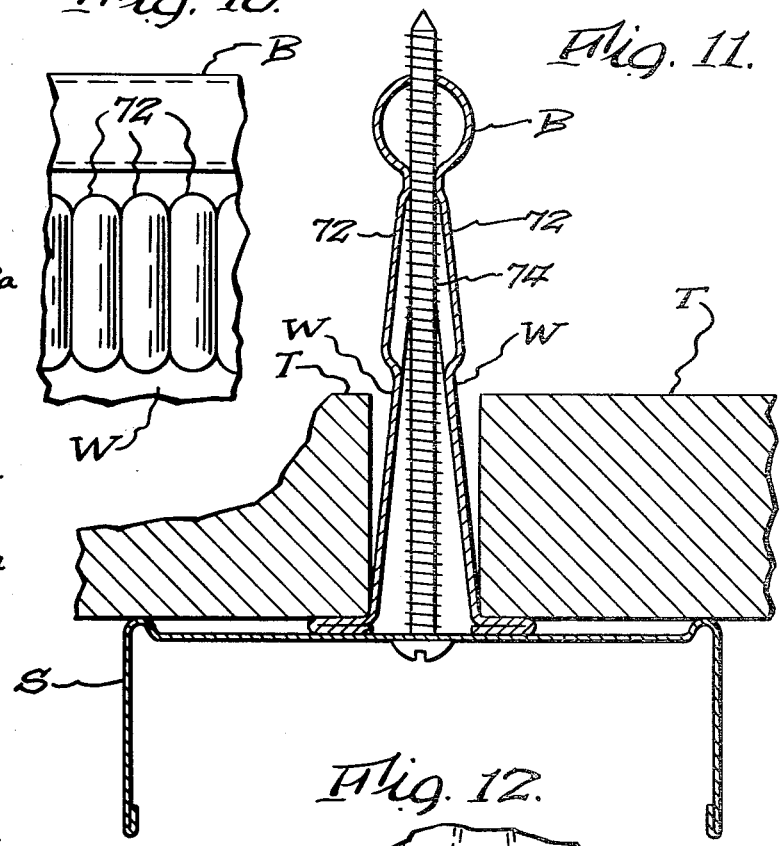
Fig. 12.
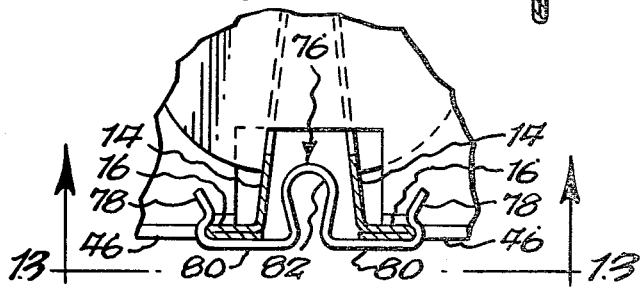
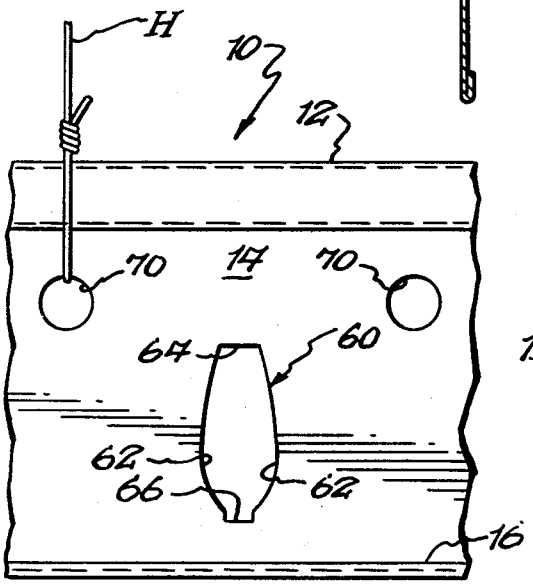
Fig. 7.
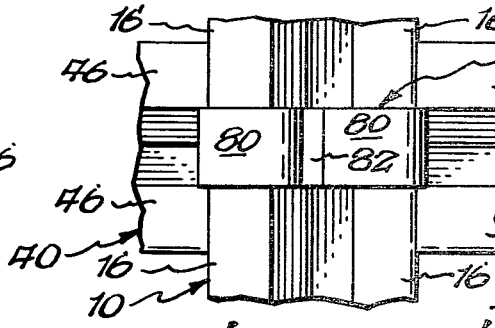
Fig. 13.
Fig. 14.
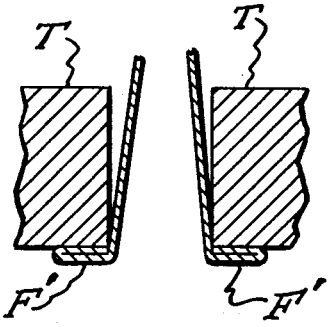
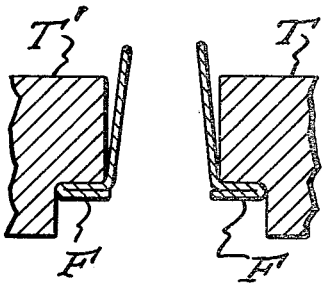
Fig. 15.

Fig. 5.
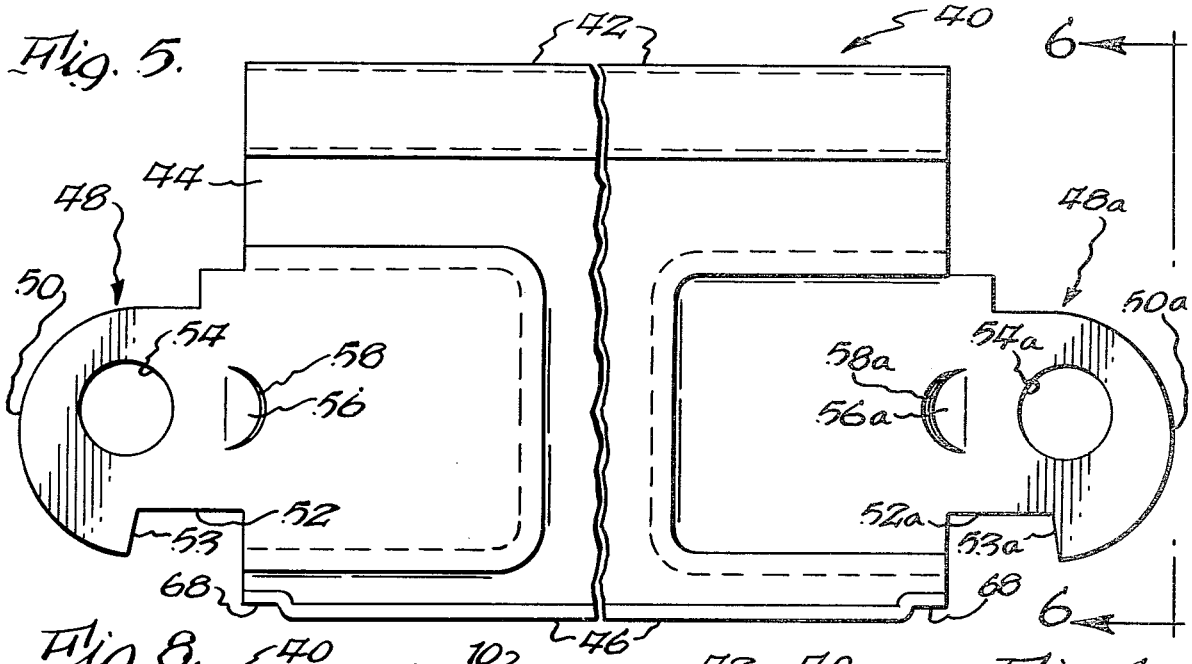
Fig. 8.
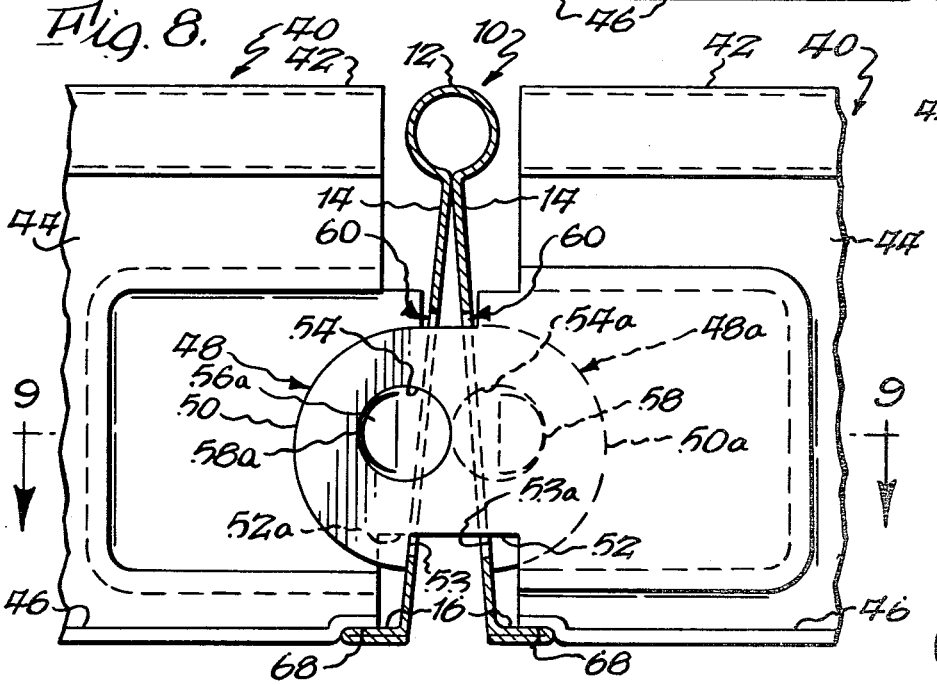
Fig. 6.
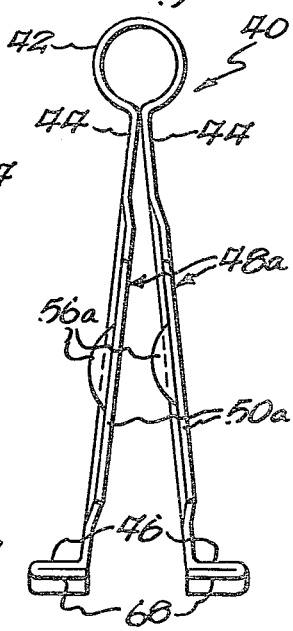
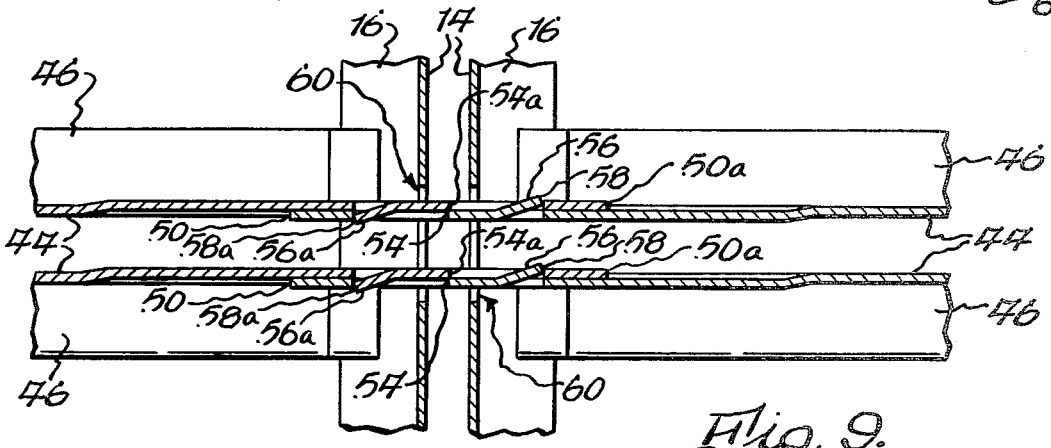
Fig. 9.

SUSPENDED CEILING GRID SYSTEM

BACKGROUND OF THE INVENTION

The present invention relates to a supporting grid system for suspended ceilings and, more particularly, to an improvement in the construction of the ceiling tile supporting members which coact to define the suspended ceiling supporting network.

The use of suspended ceilings in building construction is well known. One mode of construction provides a metal framework with longitudinal runners and lateral cross members or runners disposed at right-angles thereto and fitted together in a lattice or grid network to thereby define a plurality of modular openings. The framework is supported by hangers from overhead structure and functions to support ceiling tiles or panels, flourescent light fixtures, ventilation fixtures, and the like.

The runners and cross runners are usually of inverted T-shape with a pair of horizontally disposed flanges on opposite sides of a central upstanding, vertically disposed web section. The flanges are relatively wide in order to support the ceiling tiles while permitting sufficient clearance or tolerance between the edges of the tiles and the web sections. Architects frequently object to the appearance presented by such exposed flanges, and seek alternatives.

Various prior constructions have been proposed in an attempt to present a pleasing, thin outline for the exposed portions of the suspended ceiling tiles. One such construction incorporates a relatively wide tile supporting flange but attempts to hide the same from view by employing L-shaped lips extending below the tile supporting flange and directed inwardly toward the upstanding web of the inverted T main runner or cross runner. In this construction, rabbet-edged ceiling tiles are employed to rest on the flange and depend downwardly therefrom, substantially flush with the L-shaped lip.

Another known construction, also employing rabbet-edged tiles, provides extruded metal runners and cross runners; each having inverted U-shaped tile supporting flanges, with the metal thicknessess of the legs thereof serving as the exposed outline for the suspended ceiling.

SUMMARY OF THE INVENTION

The foregoing problems of prior art constructions, as well as others not specifically mentioned, are overcome according to the teachings of the present invention which provides a framework or grid for suspended ceilings wherein the tile supporting flanges of the main runners and the cross runners are relatively thin in width to provide an aesthetically pleasing appearance; while, at the same time, functioning to firmly and uniformly support the ceiling tiles in such a manner that the same are automatically centered within the modular opening. The use of standard-sized, straight-edged tiles is permitted, if desired, without any need to provide sufficient clearance to avoid lateral shifting and possible fall-through of the tiles. Further, the structure of the present invention precludes the necessity of, and saves the added cost of, providing additional structure to hide from view the wide flanges of prior constructions.

The invention also incorporates in the main runners and/or the cross runners relatively simple and inexpensive structure to permit lighting fixtures and the like to be easily and effectively hung therefrom, without the need for providing specially designed, costly adapters as typified by prior art constructions.

It is a further feature of this invention to provide an efficient and effective arrangement for splicing or joining main runners in abutting end to end relationship, and for securely locking the cross runners to each other in intersecting relation to the main runners.

More specifically, the main runners and the cross runners of the present invention are each characterized by a pair of resilient webs depending downwardly and outwardly from an upper tubular bulb portion to a horizontally disposed, reduced-width, tile supporting flange portion at the lower extremity of each web. The flange portions are resiliently biased in an outward direction by the webs such that supporting forces are exerted on the ceiling tiles to thereby automatically center the same and uniformly support the same in their assembled position. In this manner, thin-line, exposed flanges are observable to present a pleasing appearance without any sacrifice in the tile supporting requirements of the flanges. The interior space between the webs may be prepainted with the same color as the exposed flanges or with a contrasting color. In either case, from an observer's point of view, an aesthetically pleasing grid network is presented.

The interior walls of the webs may be provided with screw-fastener guide means to permit easy installation of lighting fixtures and the like. Such guide means preferably comprise a plurality of relatively short curved recesses in the interior facing walls of each of the webs and extending downwardly and outwardly therewith to provide a composite tubular opening sufficient to receive and guide the screw-fastener into position.

Other characterizing features and advantages of the present invention will become apparent as the detailed description thereof proceeds.

BRIEF DESCRIPTION OF THE DRAWINGS

For a fuller understanding of the invention reference should now be made to the following detailed description thereof taken in conjunction with the accompanying drawings, wherein:

FIG. 1 is an enlarged side elevational view of a main runner section constructed in accordance with the invention, with parts thereof broken away for ease of illustration;

FIG. 2 is an end elevational view of the runner looking in the direction of line 2—2 of FIG. 1;

FIG. 3 is a side elevational view, with parts thereof broken away, depicting a splice or connection between two main runners, each of which is characterized by the runner depicted in FIG. 1;

FIG. 4 is a cross-sectional view taken substantially along line 4—4 of FIG. 3;

FIG. 5 is an enlarged side elevational view of a cross runner constructed in accordance with the invention, with parts thereof broken away for ease of illustration;

FIG. 6 is an end elevational view of the crossrunner looking in the direction of line 6—6 of FIG. 5;

FIG. 7 is a partial fragmentary view of the main runner of FIG. 1 depicting one of a plurality of spaced slots in the webs thereof for receipt of adjacent cross runner sections;

FIG. 8 is a fragmentary elevational view of adjacent cross runners in operative engagement with each other and with their intersecting main runner;

FIG. 9 is a cross-sectional view taken along line 9—9 of FIG. 8;

FIG. 10 is a fragmentary side elevational view of a main runner or a cross runner depicting the application thereto of means for guiding fixture-holding fasteners;

FIG. 11 is a vertical cross-sectional view of one of the main runners or one of the cross runners depicting the manner in which a fixture is affixed thereto;

FIG. 12 is a fragmentary view of the assembled adjacent cross runner sections depicting the application of a clip means for blocking from view the coupling structure which locks each of such cross runners together;

FIG. 13 is a bottom fragmentary view looking in the direction of line 13—13 of FIG. 12;

FIG. 14 is a fragmentary cross-sectional view of one of the main runners or cross runners depicting support of a standard size square-edged ceiling tile and a slightly modified flange construction; and FIG. 15 is a view similar to FIG. 14 but depicting optional support of a rabbet-edged ceiling tile.

DESCRIPTION OF THE PREFERRED EMBODIMENTS

Referring to the drawings in detail and, more particularly, to FIGS. 1–4, a main supporting runner, generally depicted at 10, is formed to provide an upper tubular reinforcing bulb 12 or substantially circular cross-section (although other cross-sectional shapes would suffice), a pair of resilient webs 14 depending downwardly and outwardly from bulb 12 in substantial inverted V fashion, and horizontally disposed tile supporting flanges 16 integrally connecting to the lower extremities of each of webs 14 and extending outwardly therefrom. Main runner 10 can be fabricated from any single piece of any suitable material, such as thin gauge steel; however, the same is preferably rolled, folded and stamped from soft steel or the like. Alternatively, other well known methods of fabrication may be employed. The webs are inherently spring biased with a "memory" that causes them to normally maintain their spread apart position and, as such, they will offer an outward biasing force in response to inward movements.

At their opposite longitudinal ends each web 14 is integrally provided with suitable splicing or clip means to permit adjacent main runners to be rigidly joined in abutting and aligned relationship, while effectively preventing any relative twisting therebetween. To this end, one pair of web ends 18 are provided with suitable locking projection tabs or stabs 20 slightly pressed from the plane of its respective web in one lateral direction and projecting outwardly therefrom to define an upper edge surface 22, a reduced length lower surface 24, and a forward edge surface 26 upwardly and outwardly directed from lower edge surface 24 to upper surface 22 via an outwardly curved guiding edge surface 28. An elongated central reinforcing rib 30 is pressed slightly out of the plane of stab 20 in said one lateral direction and contains at its end adjacent outer edge surface 26 a laterally curved, planar edged locking element 32 protruding from the plane of stab 20 in an opposite lateral direction to thereby define an abutment or stop 34.

Each stab 20 further includes a tongue 35 pressed out of the plane thereof in one lateral direction leaving an abutment edge 36 that is substantially aligned with the projecting leading edge surfaces of the stab and is spaced inwardly of stop 34.

The opposite pair of web ends 38 are each provided with similar locking projection tabs or stabs **20*a*, except that the same (including projecting edge surfaces 22*a*, 24*a*, 26*a* and 28*a*, reinforcing rib 30*a*, locking element 32*a*, stop 34*a* and tongue 35*a*) are slightly offset in lateral directions that are opposite to that of their corresponding structure on web ends 18. As depicted in FIGS. 3 and 4, the arrangement is such that when adjacent main runner sections are brought together, the stabs on one pair of web ends 18 are guided through the tongues on the other pair of web ends 38 whereby the abutments 34 snap into locking engagement with the abutment edges 36*a* and the stabs on the other pair of web ends 38 are guided through the tongues on the other pair of web ends 18 whereby the abutments 34*a* snap into locking engagement with the abutment edges 36**, thereby providing a main runner splice.

Referring to FIGS. 5 and 6, the cross runners, generally depicted at 40, are provided with a reinforcing tubular bulb 42, a pair of resilient webs 44 and horizontally disposed tile supporting flanges 46 which are all formed in a manner similar to that of main runner 10; therefore, no further description of these elements is deemed necessary. At opposite longitudinal ends thereof each of the webs 44 are provided with suitable locking connectors, generally designated at 48, **48*a*, which, respectively project outwardly from their respective ends and are formed integral therewith. It should be noted that connectors 48, 48*a* at opposite ends of each cross runner 40 are slightly offset from the plane of their respective webs 44 in opposite lateral directions and are provided with substantially hook-shaped tabs defined by a leading curved edge 50, 50*a*; a flat bottom edge 52, 52*a*; and a web-gripping edge 53, 53*a* which, respectively, connects edges 50, 50*a* to edges 52, 52*a*. It should be noted that edges 53, 53*a* are inclined to follow the inclination angles of each of the main runner webs 14, as will become apparent hereinbelow. Each connector 48, 48*a* further includes transverse through openings 54, 54*a* located adjacent their respective curved edges 50, 50*a*. Also provided are catches 56, 56*a* aligned with and inwardly spaced from their respective openings 54, 54*a*. Catches 56 at one end of cross runners 40 may be suitably pressed out of the plane of each of the connectors 48 in one lateral direction, whereas catches 56*a* at the other end of cross runners 40 may be suitably pressed out of the plane of each of the connectors 48*a* in the opposite lateral direction. Such lateral offsetting of the catches 56, 56*a* provide the same with curved abutment edges 58, 58*a***, respectively.

Turning to FIGS. 7–9, each main runner web 14 is provided with a plurality of longitudinally spaced cross runner slots 60 (only one of which being illustrated); the slots on one web being disposed for alignment with their corresponding slots on the other web. Each slot 60 is formed with a pair of curved side edges 62, a flat upper edge 64 and a notched lower edge 66 to thereby define substantially the profile of an inverted bottle. The spacing between top edge 64 and the bottom of lower edge 66 substantially corresponds to the vertical extent of the leading curved edges 50, **50*a* of the connectors 48, 48*a***.

Adjacent cross runners 40 may be rigidly coupled to each other through slot 60 in locking engagement therewith to define the intersecting grid structure for supporting the ceiling tiles. Alternatively, only one cross runner may be locked through the slot 60, if desired or required. More specifically, as adjacent cross runners are joined together through slots 60 adjacent aligned connectors 48, **48*a* on each are snap-locked together by engagement of openings 54, 54***a* with their respective abutment edges 58*a*, 58 of catches 56*a*, 56, respectively, as clearly indicated in FIG. 9.

As the curved leading edges 50 and the curved leading edges 50*a* of their respective connectors are brought into contact with their respective slots 60 the same are engaged by the side edges 62 which cause connectors to compress to the width of the bottom notch 66. When each connector edge surface 53, 53*a* passes through both aligned slots, the connectors are free to expand to their normal position with the top edges 52, 52*a* thereof resting on slot side edges 62 above notch 66 and with edge surfaces 53, 53*a* gripping their respective main runner webs along a surface of the webs on each side of slot edges 62 adjacent notch 66. In this manner, opposite pull through of the cross runners is prevented unless the webs are deliberately compressed to permit the connectors to pass through notch 66 of the slot. Thus, the relationship between the connectors and the slots is such as to permit automatic straight-through insertion without the necessity of any manual squeezing of the cross runner webs. In their assembled position the cross runner flanges 46 are maintained substantially coplanar or flush with the main runner flanges 16 by means of an offset or relieved portion 68 on the ends of cross runner flanges 46.

As illustrated in FIG. 7, each main runner web 14 may be provided with a plurality of longitudinally spaced openings 70. Suitable hangers H may pass through selected openings 70 for suspending the main runners from overhead support structure, as is conventional.

It should be apparent, from the structure of the present invention as thus far described, that the tile supporting flanges on the main runners and the cross runners are substantially narrower (in a lateral sense) than would be required in constructions employing conventional inverted T-shaped members. Whereas in a conventional inverted T construction the flanges on each side of the web must be sized to permit sufficient tolerance within the modular grid for adequate support of the tile, the flanges of the present invention need only be of a size sufficient for the actual support of the tile and not any larger to provide for such tolerances as typified by prior art constructions. It should be understood that the spring action of the resilient webs, on the main runners and the cross runners, provides or permits automatic centering and support of the tiles without any need for greater flange widths. Moreover, no additional structure is required to hide the actual supporting flanges from view to give the appearance of a narrower grid network. Further, in the event of slight tile shrinkage due to fire or other sources of high heat, the resilient webs will expand to permit the flanges to move outwardly for continued tile support.

It is a further feature of the present invention to provide a simple and effective means for permitting lighting fixtures and the like to be supported from either the main runners or the cross runners without any need for special adaptors or the like.

Prior to a discussion of such means as depicted in FIGS. 10 and 11 and to such other features or arrangements as depicted in FIGS. 14 and 15, it should be noted that these FIGURES depict main runner and/or cross runner structure. Therefore, generic designation shall be employed to indicate various parts of such structure that are clearly common to both main runners and cross runners.

Thus, turning to FIGS. 10 and 11, the web W of either a main runner or a cross runner may be provided with a plurality of adjacent recesses or serrations 72. Each recess 72 is preferably formed integral with its respective web and pressed out of the inner surfaces thereof adjacent the bulb portion B to extend downwardly and outwardly therefrom to a point between the upper and lower extremities of the webs. Recesses 72 on each web W are disposed for alignment with corresponding recesses on the opposite web to thereby define composite channels or tubular openings for guiding and receiving suitable fasteners or metal screws 74. As depicted in FIG. 11, the arrangement is such that a fixture or a support S for a partition head channel or the like may be brought into engagement with ceiling tiles T and affixed to runner bulbs B by means of the sheet metal screw or the like 74 which is guided through the composite openings defined by the facing recesses 72 and secured through the bulb portion B.

As depicted in FIGS. 12 and 13, the present invention further contemplates the employment of a suitable means to maintain the thin-line, exposed grid appearance in the locations where the cross runners intersect the main runners. To this end, a clip, generally designated at 76, is provided for removable attachment to flanges 16 of main runner 10 to substantially span the gap between the flanges 46 of adjacent connected cross runners 40. More specifically, clip 76 is fabricated of a suitable resilient, spring-like material and has a pair of upwardly and outwardly directed snap fingers 78 connecting to a pair of substantially planar horizontally disposed sections 80 which, in turn, connect to an upwardly directed and centrally located substantially inverted U-shaped portion 82 extending upwardly into the space between main runner webs 14. The arrangement is such that spring fingers 78 removably snap onto the outer edges of main runner flanges 16 to permit clip 76 to bridge the space between adjacent connecting cross runners 40 whereby the connecting or coupling structure thereof is hidden from view. Thus, the continuity of the outline of the grid network is preserved as normally seen from an observer's point of view. Inverted U-shaped portion 82 functions to simulate the appearance of the shadow space formed between the inner surfaces of oppositely inclined main runner webs 14.

As noted earlier, the exposed surfaces of flanges 16 and 46 may be prepainted or coated prior to forming with a color contrasting to that of the space between their respective webs 14 and 44. In which case, the main runners and the cross runners would have their flanges folded in such a manner as to reverse the surfaces thereof to enable one color to appear between the webs and the contrasting color exposed on the flanges. This folding arrangement has been disclosed throughout the drawings but is highlighted at F in FIG. 15. However, if it were desired to expose the same colors between the webs and on the exposed portions of the flanges, then the flanges could be folded opposite to the folds of FIG. 15 as depicted at F′ in FIG. 14.

FIG. 15 also illustrates the optional employment of rabbet-edged ceiling tiles T′ for support by the main runner flanges and the cross runner flanges.

Although preferred embodiments of the present invention have been disclosed and described in detail, changes will obviously occur to those skilled in the art. It is, therefore, intended that the present invention is to be limited only by the scope of the appended claims.

What is claimed is:

1. A supporting grid system for suspension ceilings and the like, comprising a plurality of assembled and interconnected main and cross runners cooperating to define tile openings, each of said runners including a pair or resilient webs, tile supporting flanges extending outwardly from the lower end portions of said webs, and means supporting the webs in such a manner that the lower end portions of said webs are normally spaced apart when said runners are assembled and in an unstressed condition, the lower portions of said webs being capable of being moved toward each other in response to forces applied thereto by associated edges of tile positioned in said openings and supported on said flanges, said movement resiliently stressing said webs to cause said webs to center said tile, a longitudinally disposed reinforcing member integrally connected to each of said webs at the upper extremity thereof, at least one pair of aligned slots in said main runner webs, and locking connector means projecting from at least one end of each of said cross runner webs for supporting said cross runners on said main runners through said pair of slots, said connector means including a substantially hook shaped end projecting from each of said cross runner webs, and said slots are so shaped as to compress said resilient cross runner webs inwardly upon insertion of said hook shaped ends through said slots until a portion of said hook shaped ends passes through said slot that is further from the point of entry thereof where upon compression on said webs is relieved and said portions are extended an overlapping relation surface portions of said web adjacent the side edges of said last mentioned slot to thereby prevent said cross runners from being pulled through said slots.

2. The system according to claim 1, wherein said portion of said hook-shaped ends is inclined at an angle corresponding to the angle of inclination of said surface portions of said webs.

3. The system according to claim 1, wherein said slots have curved side edges, flat top edges and a notched bottom edge whereby said connectors are compressed inwardly by said side edges to pass through said notched bottom end upon insertion thereof through said slots.

4. The system according to claim 3, wherein the vertical extent of said connectors corresponds substantially to the vertical extent of said slots.

5. A narrow face grid suspension ceiling and the like comprising a plurality of elongated grid members including a bulb along an upper edge, depending means depending from said bulb, and narrow panel supporting flanges extending in opposite directions from the depending means at the extremity thereof remote from said bulb, said members being substantially symmetrical with respect to a central vertical plane, said grid members being interconnected to define a plurality of rectangular panel openings having a modular size determined by the spacing between said central planes of said grid members on opposite sides of said openings, said flanges being exposed to view below said ceiling and extending around and defining said openings, and panels having lateral dimensions less than said modular size and a lower face extending to the lateral edges thereof, said lower face resting on said flanges, said depending means centering said panels in said openings and spacing said lateral edges from said central planes, said flanges having a lateral width insufficient to provide proper support for noncentered panels by sufficiently wide to engage in support panels centered in said openings by said depending means.

6. A suspension ceiling or the like as set forth in claim 5 wherein said depending means include two symmetrically located webs which are spaced apart at the lower edges thereof to position said flanges of said grid members laterally spaced from each other, said flanges and said webs cooperating to define an upwardly extending recess lengthwise of said grid members.

7. A suspension ceiling and the like as set forth in claim 6 wherein said laterally spaced webs engage said edges of said panels and operate to center said panels in said opening.

8. A suspension ceiling and the like as set forth in claim 5 wherein said depending means include web means providing laterally spaced portions engaging said edges of said panels and operating to center said panels in said openings.

9. A suspension ceiling and the like as set forth in claim 8 wherein said web means are resilient and engage said edges of said panels to resiliently center panels and said openings.

10. A suspension ceiling and the like as set forth in claim 5 wherein said depending means provide laterally spaced portions adjacent to and said flanges engaging said edges of said panels and operating to center said panels and said openings.

11. A suspension ceiling and the like as set forth in claim 10 wherein said lower face of said panels engage the associated of said flanges along the entire width of said flanges.

* * * * *

UNITED STATES PATENT AND TRADEMARK OFFICE

CERTIFICATE OF CORRECTION

PATENT NO. : 4,470,239

DATED : September 11, 1984

INVENTOR(S) : Gale E. Sauer

It is certified that error appears in the above—identified patent and that said Letters Patent is hereby corrected as shown below:

IN THE CLAIMS

Claim 5, Column 8, line 18, "by" should read as "but".

Claim 5, Column 8, line 19, "in" first occurrence should read as "and".

Signed and Sealed this

*Nineteenth* Day of *February 1985*

[SEAL]

*Attest:*

DONALD J. QUIGG

*Attesting Officer*

*Acting Commissioner of Patents and Trademarks*